US008052182B1

(12) United States Patent
Weinerman et al.

(10) Patent No.: US 8,052,182 B1
(45) Date of Patent: Nov. 8, 2011

(54) HANDLE AND HOUSING ASSEMBLY WITH SKIRTED SEAL

(75) Inventors: Lee S. Weinerman, Medina, OH (US); Michael J. Hollingsworth, Brookpark, OH (US)

(73) Assignee: The Eastern Company, Strongsville, OH (US)

( * ) Notice: Subject to any disclaimer, the term of this patent is extended or adjusted under 35 U.S.C. 154(b) by 72 days.

(21) Appl. No.: 12/380,067

(22) Filed: Feb. 23, 2009

Related U.S. Application Data

(63) Continuation of application No. 11/366,717, filed on Mar. 2, 2006, now abandoned, which is a continuation-in-part of application No. 11/079,328, filed on Mar. 14, 2005, now Pat. No. 7,398,664, and a continuation-in-part of application No. 29/226,005, filed on Mar. 23, 2005, now Pat. No. Des. 543,434, and a continuation-in-part of application No. 29/251,227, filed on Jan. 5, 2006, now Pat. No. Des. 548,560, which is a continuation-in-part of application No. 29/226,005, filed on Mar. 23, 2005, now Pat. No. Des. 543,434.

(51) Int. Cl.
*E05B 3/00* (2006.01)

(52) U.S. Cl. ..... 292/336.3; 292/DIG. 53

(58) Field of Classification Search ..... 70/208–211, 70/224; 292/336.3, DIG. 53
See application file for complete search history.

(56) References Cited

U.S. PATENT DOCUMENTS

| | | | | |
|---|---|---|---|---|
| D119,418 | S | 3/1940 | Anderson et al. | D8/306 |
| 2,402,348 | A | 6/1946 | Schroeder | 292/164 |
| 2,729,089 | A | 1/1956 | Pelcin | 70/151 |
| 2,735,706 | A | 2/1956 | Pelcin | 292/34 |
| 2,991,904 | A | 7/1961 | Carideo | 220/44 |
| 3,333,878 | A | 8/1967 | Pelcin | 292/37 |
| 3,457,744 | A | 7/1969 | Bisbing | 70/82 |
| 3,745,796 | A | 7/1973 | Fleming | 70/81 |
| 3,953,061 | A | 4/1976 | Hansen et al. | 292/5 |
| 4,370,874 | A | 2/1983 | Munn | 70/204 |
| 4,641,865 | A | 2/1987 | Pastva | 292/5 |
| 4,706,478 | A | 11/1987 | Swan et al. | 70/208 |
| 4,714,283 | A | 12/1987 | Dignan | 292/48 |
| 4,838,054 | A | 6/1989 | Weinerman et al. | 70/248 |
| 4,892,338 | A | 1/1990 | Weinerman et al. | 292/35 |
| D316,365 | S | 4/1991 | Hansen et al. | D8/331 |

(Continued)

OTHER PUBLICATIONS

Eberhard Catalog #109, pp. 102-104, Eberhard Manufacturing Co., Cleveland Ohio 44149 Showing Products 9000-55, 9001-55 & Related Items ® 2004.

(Continued)

*Primary Examiner* — Kristina Fulton
(74) *Attorney, Agent, or Firm* — David A. Burge

(57) ABSTRACT

A handle and housing assembly has a graspable handle turnable about a principal axis relative to a housing, structure extending from the handle along the principal axis through an opening defined by the housing, and a seal that turns with the handle and defines a thin annular skirt of resilient material extending about the principal axis and pressed substantially flatly into engagement with an annular portion of the housing extending substantially concentrically about the opening. In some embodiments, the structure includes a shaft that extends from the handle through a spacer that is encircled by the skirted seal; in some embodiments, an O-ring is interposed between the handle and the spacer; and, in some embodiments, a rear part of the spacer extends into the housing opening to facilitate smooth turning of the handle and the spacer about the principal axis.

18 Claims, 10 Drawing Sheets

U.S. PATENT DOCUMENTS

| | | | | | |
|---|---|---|---|---|---|
| 5,015,019 | A | | 5/1991 | Razdolsky | 292/200 |
| D317,398 | S | | 6/1991 | Hansen et al. | D8/336 |
| 5,052,869 | A | | 10/1991 | Hansen, II | 410/111 |
| D323,776 | S | | 2/1992 | Hansen | D8/338 |
| D323,970 | S | | 2/1992 | Schlack | D8/341 |
| D328,231 | S | | 7/1992 | Hansen | D8/301 |
| 5,269,161 | A | * | 12/1993 | Stillwagon | 70/34 |
| 5,409,272 | A | | 4/1995 | McCormack | 292/66 |
| 5,457,971 | A | * | 10/1995 | Yamada | 70/208 |
| 5,509,703 | A | | 4/1996 | Lau et al. | 292/1 |
| 5,526,660 | A | | 6/1996 | Bennett et al. | 70/208 |
| 5,585,578 | A | | 12/1996 | Shimotori | 84/95.2 |
| 5,595,076 | A | | 1/1997 | Weinerman et al. | 70/208 |
| D389,393 | S | | 1/1998 | Hansen | D8/310 |
| 5,938,248 | A | | 8/1999 | Vickers et al. | 292/36 |
| 5,984,383 | A | | 11/1999 | Parikh et al. | 292/121 |
| D427,882 | S | | 7/2000 | Wytcherley et al. | D8/331 |
| D442,844 | S | | 5/2001 | Mirick | D8/301 |
| D456,237 | S | | 4/2002 | Sokurenko et al. | D8/307 |
| 6,454,321 | B1 | | 9/2002 | Parikh | 292/216 |
| 6,490,895 | B1 | | 12/2002 | Weinerman et al. | 70/208 |
| D469,678 | S | | 2/2003 | Teskey | D8/301 |
| 6,513,353 | B1 | | 2/2003 | Weinerman et al. | 70/208 |
| 6,530,250 | B1 | * | 3/2003 | Linares et al. | 70/208 |
| 6,532,778 | B2 | | 3/2003 | Molzer et al. | 70/208 |
| 6,623,052 | B2 | | 9/2003 | Hansen | 292/336.3 |
| D484,024 | S | | 12/2003 | Teskey et al. | D8/331 |
| 6,666,053 | B2 | | 12/2003 | Sadler | 70/210 |
| 6,668,602 | B2 | | 12/2003 | Graham et al. | 70/208 |
| D488,994 | S | | 4/2004 | Hansen | D8/350 |
| D490,292 | S | | 5/2004 | Hansen | D8/352 |
| 6,952,940 | B2 | | 10/2005 | Molzer et al. | 70/210 |
| D520,328 | S | | 5/2006 | Hansen | D8/301 |
| 7,124,475 | B2 | | 10/2006 | Jeffries | 16/445 |

OTHER PUBLICATIONS

Eberhard Catalog #107, pp. 67-69, Eberhard Manufacturing Co., Cleveland Ohio 44149 Showing Products 9000-55, 9001-55 & Related Items ® 1996.

* cited by examiner

HANDLE AND HOUSING ASSEMBLY WITH SKIRTED SEAL

REFERENCE TO RELATED APPLICATIONS

This is a continuation of utility application Ser. No. 11/366,717 filed Mar. 2, 2006 now abandoned, by Lee S. Weinerman et al, entitled HANDLE AND HOUSING ASSEMBLY WITH SKIRTED SEAL, the disclosure of which is incorporated herein by reference.

The above application Ser. No. 11/366,717 was filed as a continuation-in-part of three earlier-filed applications, namely a utility application and two design applications, as follows:

A) Utility application Ser. No. 11/079,328 filed Mar. 14, 2005 now U.S. Pat. No. 7,398,664, by Lee S. Weinerman et al, entitled HANDLE AND HOUSING ASSEMBLY (referred to hereinafter as the "Parent Utility patent"), the disclosure of which is incorporated herein by reference; and, B) Design application Ser. No. 29/226,005 filed Mar. 23, 2005 now U.S. Pat. No. D,543,434, by Lee S. Weinerman et al, entitled FRONT PORTIONS OF A HANDLE AND HOUSING ASSEMBLY, the disclosure of which is incorporated herein by reference; and, C) Design application Ser. No. 29/251,227 filed Jan. 5, 2006 now U.S. Pat. No. D,548,560, by Lee S. Weinerman et al, entitled FRONT PORTIONS OF A HANDLE AND HOUSING ASSEMBLY, the disclosure of which is incorporated herein by reference.

The two design applications identified just above are referred to collectively hereinafter as the "Parent Design patents." The aforementioned design case Ser. No. 29/251,227 was filed as a continuation-in-part of the aforementioned design case Ser. No. 29/226,005 filed Mar. 23, 2005 now U.S. Pat. No. D,543,434.

BACKGROUND OF THE INVENTION

1. Field of the Invention

The present invention relates generally to handle and housing assemblies that can be used to operate devices such as latches which retain closures in closed positions, and addresses the need to prevent moisture and debris from migrating along structure extending rearwardly from the handle through an opening of the housing. More particularly, the present invention relates to a handle and housing assembly having a handle that can be grasped and turned about a principal axis relative to a housing, structure extending from the handle along the principal axis through an opening defined by the housing, and a seal that turns with the handle and defines a thin annular skirt of resilient material extending about the principal axis and pressed substantially flatly into engagement with an annular portion of the housing extending substantially concentrically about the opening.

Commercially available handle and housing assemblies have a wide range of uses. Many are purchased by manufacturers of vehicle cabinetry, industrial cabinets, toolboxes and the like for use in products having latches that can be operated by turning a handle relative to an associated housing.

Many housing and handle assemblies have handles that are movable between retracted positions near their associated housings and extended positions projecting forwardly from the associated housings to enable the handles to be grasped and turned with ease to turn shafts connected to the handles. Some handle and housing assemblies have housings that define forwardly facing recesses and employ handles that, when retracted, nest within the forwardly facing recesses of their associated housings.

The handle-connected shafts of some handle and housing assemblies are used to move latch elements into and out of latched positions wherein the latch elements are engageable with strikes or other structure to retain associated closures in closed positions. The shafts of other handle and housing assemblies are used to turn so-called "latch operating elements" between non-operated and operated positions. Links connected to the latch operating elements cause remotely located latches to operate when the latch operating elements are turned to their operated positions. Rigid links such as rods may be pushed or pulled by a latch operating element to cause one or more remotely located latches to operate. Flexible links such as cables may be pulled by a latch operating element to cause one or more remotely located latches to operate.

Patents assigned to The Eastern Company which disclose handle and housing assemblies having handles that are movable between retracted and extended positions, and that can be turned, while extended, to turn shafts of the assemblies, include U.S. Pat. No. 4,838,067 issued Jun. 13, 1989 to Weinerman et al, U.S. Pat. No. 4,838,054 issued Jun. 13, 1989 to Weinerman et al, and U.S. Pat. No. 4,706,478 issued Nov. 17, 1987 to Swan et al, the disclosures of which are incorporated herein by reference. The referenced Parent Utility patent also discloses handle and housing assemblies of this type.

A patent assigned to The Eastern Company which discloses a handle and housing assembly that not only turns a shaft-connected latch element between latched and unlatched positions but also turns a shaft-connected latch operating element to move links to release a pair of remotely located latches, is U.S. Pat. No. 4,641,865 issued Feb. 10, 1987 to Pastva, the disclosure of which is incorporated herein by reference.

Other patents assigned to The Eastern Company that disclose a variety of types of handle and housing assemblies used to operate pairs of links to release remotely located latches include U.S. Pat. No. 6,513,353 issued Feb. 4, 2003 to Weinerman et al, U.S. Pat. No. 6,490,895 issued Dec. 10, 2002 to Weinerman et al, U.S. Pat. No. 5,595,076 issued Jan. 21, 1997 to Weinerman et al, U.S. Pat. No. 4,892,338 issued Jan. 9, 1990 to Weinerman et al, U.S. Pat. No. 3,333,878 issued Aug. 1, 1961 to Pelcin, U.S. Pat. No. 2,735,706 issued Feb. 21, 1956 to Pelcin, and U.S. Pat. No. 2,729,089 issued Jan. 3, 1956 to Pelcin, the disclosures of which are incorporated herein by reference.

Some commercially available handle and housing assemblies are lockable, either by inserting and turning a key in a housing-carried lock, or by attaching a padlock to the assembly to prevent relative movement of selected components of the assembly. Many of the handle and housing assemblies disclosed in the patents listed above are lockable by one or the other of these techniques.

It is known to incorporate biasing elements such as springs, and detent elements that are spring-biased to engage formations such as notches or holes among the relatively movable components of lockable and non-lockable latching systems that are operated by handles turned about forwardly-rearwardly extending axes, as is exemplified by the disclosure of the aforementioned U.S. Pat. No. 3,333,878 assigned to The Eastern Company.

It is known to interpose a steel washer or a spacer formed from steel or plastics material between a central part of the handle and a central portion of the back wall of the housing of a handle and housing assembly to space the central part of the handle forwardly from the housing's back wall, as is exemplified by the disclosures of a number of the patents identified above, and by the disclosures of the referenced Parent Design patents.

Although it is known to provide handle and housing assemblies with seals, typically O-rings, that are intended to inhibit unwanted migration of moisture and debris along the rearwardly extending shafts of handles and through back wall openings of housings, the need for improved seals has been long-standing, especially in applications where handle and housing assemblies are subjected to dusty, dirty or sandy conditions, where moisture is prevalent, and/or where handle and housing assemblies are subjected to vibration that facilitates migration of moisture and particulate debris along surfaces and through openings.

SUMMARY OF THE INVENTION

In some embodiments of the invention, a handle and housing assembly includes a graspable handle that can be turned about a principal axis relative to a housing, together with structure that extends from the handle along the principal axis through an opening defined by the housing, and a seal that turns with the handle and defines a thin annular skirt of resilient material extending about the principal axis and pressed substantially flatly into engagement with an annular portion of the housing extending substantially concentrically about the opening.

In some embodiments, the structure that extends from the handle along the principal axis includes a shaft and a spacer that turn in unison with the handle, wherein the shaft extends from the handle through the spacer, through the seal and through the handle opening, and wherein the seal extends perimetrically about a perimeter surface of the spacer and is pressed by the spacer against the annular portion of the housing. In some embodiments, an O-ring seal is provided near the front of a passage formed through the spacer to minimize migration of moisture and debris rearwardly through the spacer passage. And, in some embodiments, a rear part of the spacer extends into the housing opening.

In other embodiments of the invention, a skirted seal extends perimetrically about structure that extends along a principal axis between a housing and a handle that can be grasped to turn the structure and the seal about the principal axis relative to the housing, wherein the seal defines a thin annular skirt of resilient material pressed substantially flatly against an annular portion of the housing that substantially concentrically surrounds an opening of the housing into which the structure extends.

In still other embodiments, a handle and housing assembly includes a handle that can be grasped to turn a shaft relative to a housing about a principal axis extending from the handle through an opening formed through the housing, and having a seal connected to the handle to turn therewith about the principal axis and defining a thin annular skirt of resilient material extending about the principal axis and pressed substantially flatly against an annular portion of the housing extending substantially concentrically about the opening. In some of these embodiments, a spacer that encircles the shaft and defines a perimeter surface that is encircled by the seal. And, in some of these embodiments, an O-ring seal is engaged by and compressed between a surface of the spacer and a surface of the handle that extend substantially concentrically about the principal axis.

BRIEF DESCRIPTION OF THE DRAWINGS

These and other features, and a fuller understanding of the invention will be gained from the description and claims that follow, taken together with the accompanying drawings, wherein:

DETAILED DESCRIPTION

Figure 1:
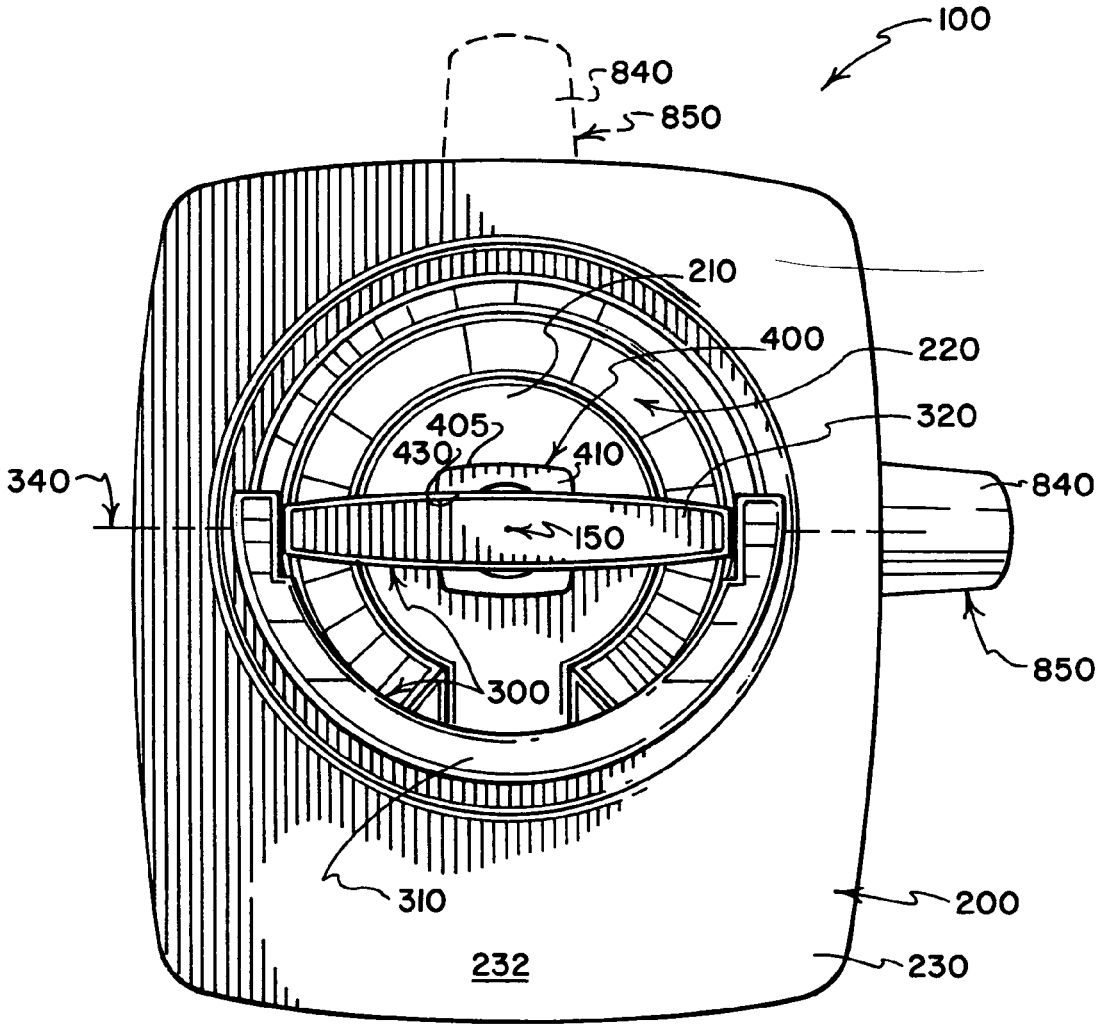
FIG. 1 is a front elevational view of a handle and housing assembly with the handle thereof retracted into a forwardly facing recess of the housing, with a latch arm that can be turned by the handle and housing assembly depicted by solid lines in a first position, and by broken lines in a second position.
Figure 2:
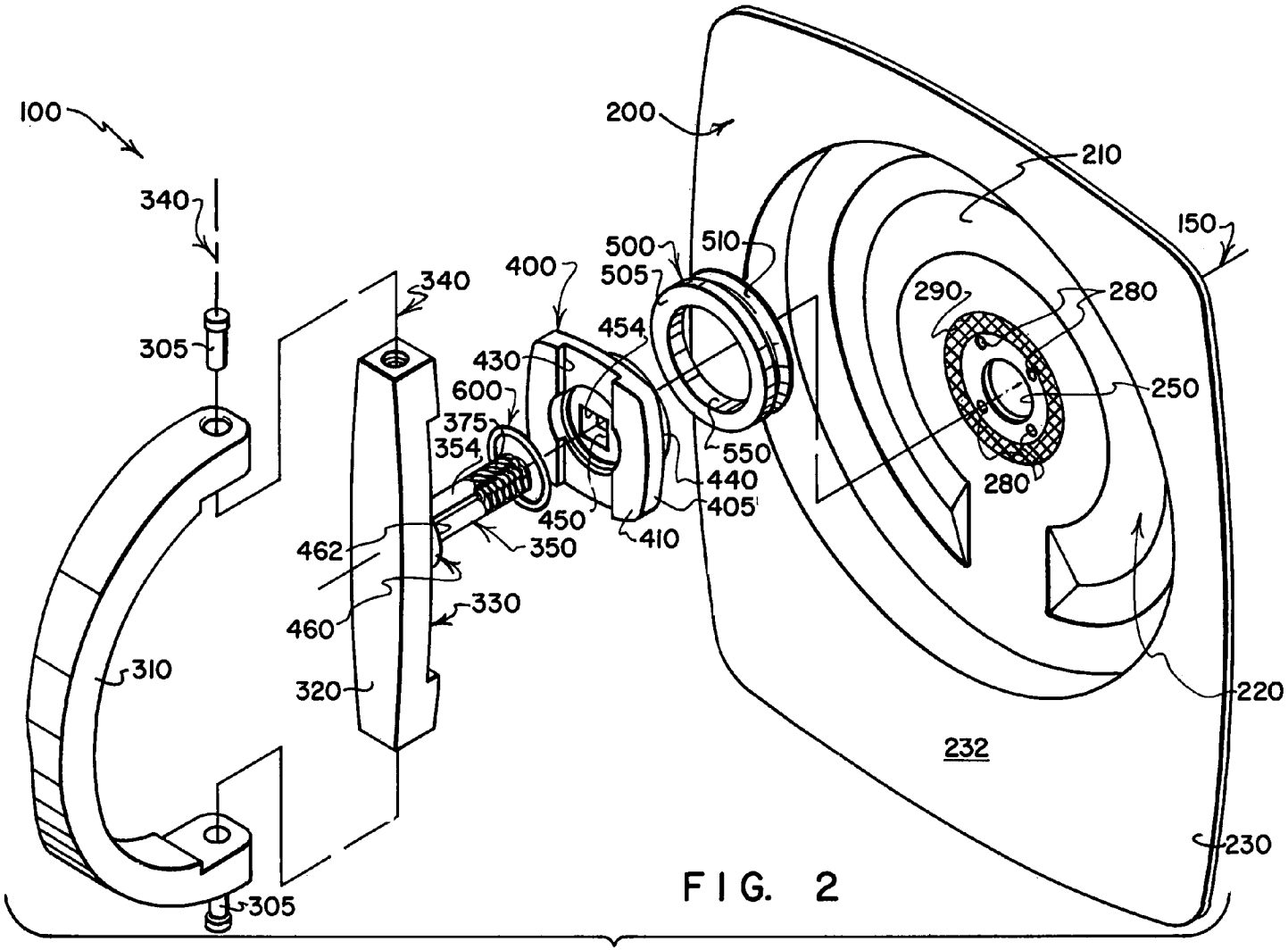
FIG. 2 is an exploded perspective view showing selected front components of the handle and housing assembly including a curved bail, a T-shaped crossbar and pivot pins of the handle, and showing a shaft together with a spacer and seals that are are installed on the shaft during assembly, wherein the seals include a resilient O-ring and a resilient, skirted annular seal that cooperate with front and rear portions of the spacer, with a projection, on the crossbar of the handle, and with the back wall of the housing to minimize migration of moisture and debris along the shaft and through a central opening defined by the back wall of the housing, with a relatively wide band of front surface area of the back wall that is substantially flatly engaged when the skirt of the skirted seal is pressed against the back wall of the housing being schematically depicted by a darkened ring extending substantially concentrically about the back wall opening at a distance radially spaced therefrom.
Figure 6:
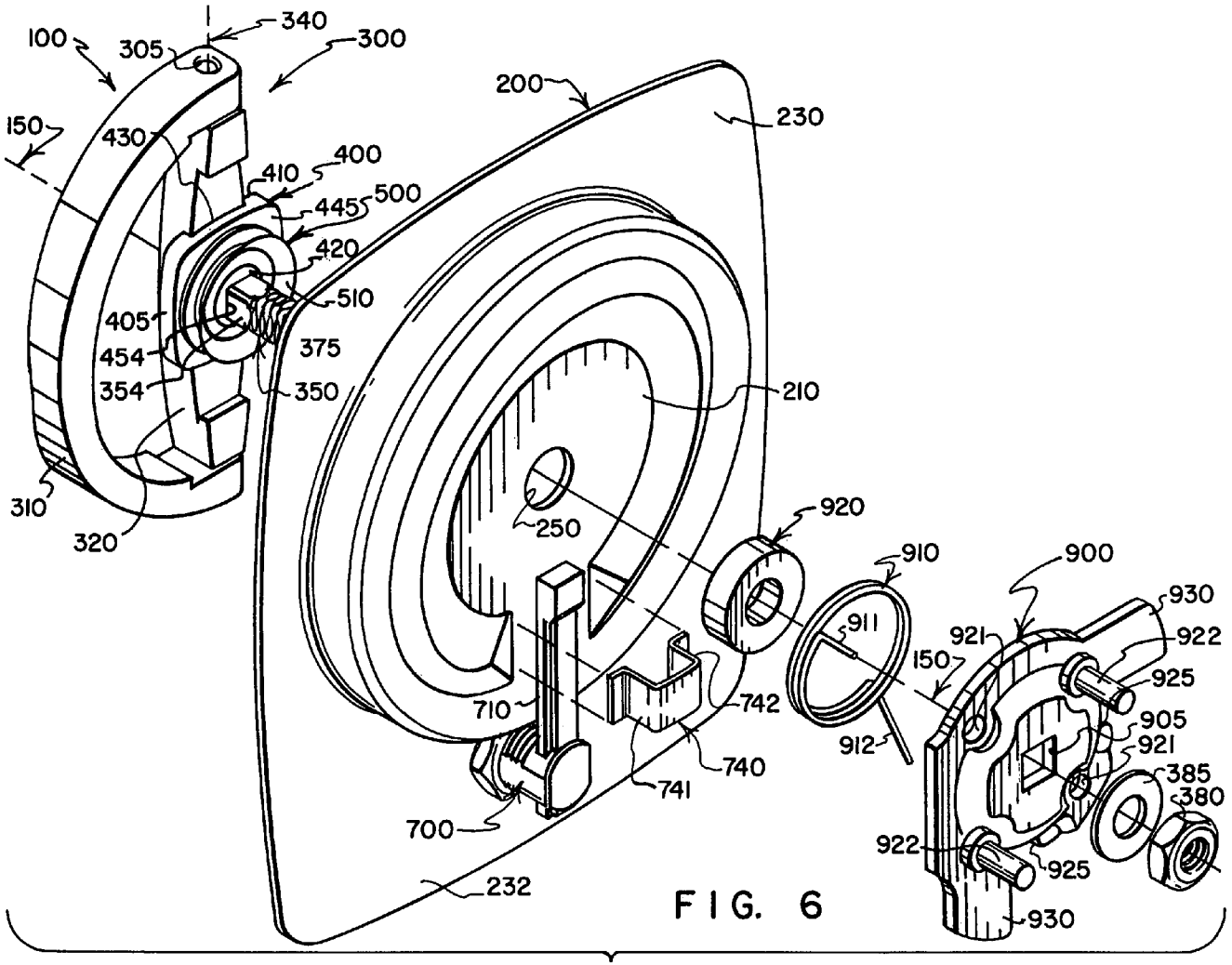
FIG. 6 is an exploded perspective view showing selected components of the handle and housing assembly including the handle, the housing, the shaft, the spacer, the skirted seal, and an alternate selection of components that may be mounted on the shaft on the rear side of the housing including an L-shaped latch element and a torsion spring that can be interposed between the housing and the latch element, and showing components of a key-operated lock having a slidable bolt that can engage the latch element to retain the latch element and the handle in selected positions to which the handle and latch element may be turned about the principal axis.

Referring to FIGS. 1, 2 and 6, a handle and housing assembly 100 that embodies features of the present invention includes a housing 200 and a handle 300. Referring to FIG. 2, a shaft 350 extends rearwardly from a crossbar 320 of the handle 300 along a "principal axis" 150 that extends forwardly-rearwardly through an opening 250 formed through a back wall 210 of the housing 200.

Referring still to FIG. 2, a spacer 400 and seals 500, 600 are installed on the shaft 350 at a location between the crossbar 320 of the handle 300 and the back wall 210 the housing 200. When assembled, the spacer 400 and the seals 500, 600 cooperate with the handle 300 and the housing 200 to minimize migration of moisture and debris along the shaft 350 and through the back wall opening 250. The spacer 400 is preferably formed from a rigid, wear resistant plastics material. The seal 500 is preferably formed from a resilient, wear resistant rubbery material.

Figure 3:
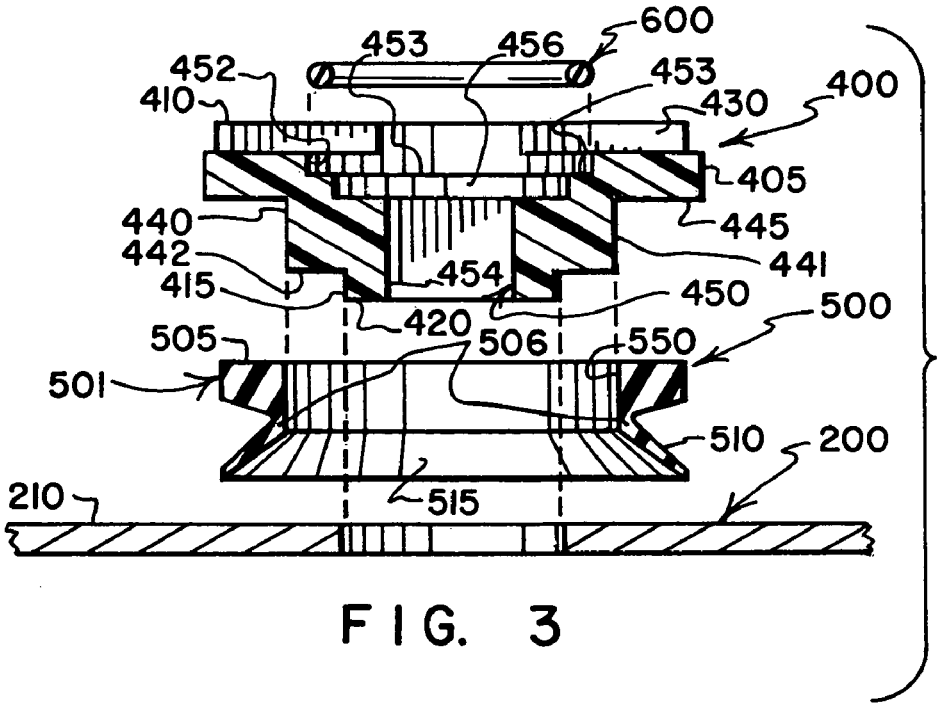
FIG. 3 is an exploded cross-sectional view, on an enlarged scale, showing a central portion of the back wall of the housing, and showing "halves" of the spacer and the seals that are depicted in FIG. 2, with the normally curved nature of the skirt of the skirted seal being shown as it appears before being pressed against the back wall of the housing.
Figure 4:
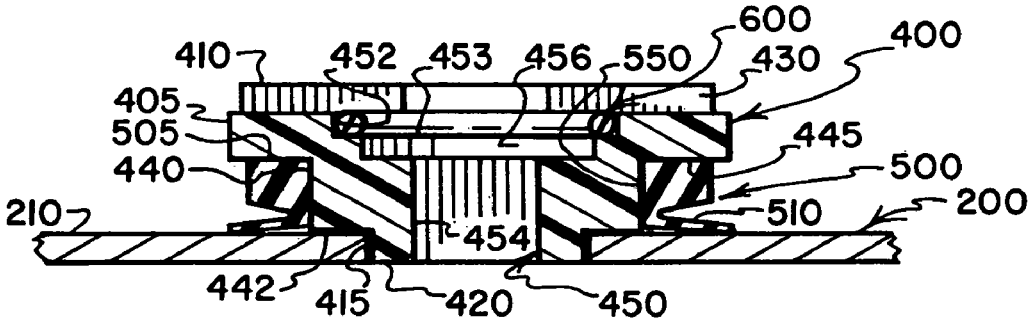
FIG. 4 is a cross-sectional view on the same scale as FIG. 3 showing the elements of FIG. 3 as they appear during one stage of assembly of the handle and housing assembly, with this view illustrating the manner in which the skirt of the skirted seal is deformed when pressed against the housing's back wall to substantially flatly engage portions of the front surface of the back wall.

Because the seal 500 has a relatively thin skirt formation 510 that projects away from the principal axis 150 and extends without interruption to define a skirtlike perimeter of the seal 500, the seal 500 is referred to as a "skirted seal." When the skirt 510 of the seal 500 is pressed into engagement with the housing 200 (so the skirt 510 deforms from its normal curved shape as depicted in cross-section in FIG. 3 to the flattened configuration depicted in cross-section in FIG. 4), the skirt 510 engages a relatively wide band—a relatively wide annular ring—of front surface area of the back wall 210 of the housing 200, as depicted schematically in FIG. 2 by a darkened area 290.

To draw the shaft 350 rearwardly along the principal axis 150 through the housing opening 250, and to thereby cause the skirt 510 of the seal 500 to be pressed (by rearward movement of the handle 300 and the spacer 400) against a front surface of the housing 200 as depicted in FIG. 4, a rear end region 375 of the shaft 350 is threaded to receive thereon a threaded locknut 380 that, as it is tightened onto the shaft, engages a washer 385 to press other components installed on the rear end region 375 of the shaft 350 toward the housing 200. The use of a locknut 380 installed on a threaded rear end region of a shaft of a handle and housing assembly is well known to those skilled in the art.

What, in essence, that the shaft 350 and the spacer 400 provide, can be referred to as "structure" that extends along the principal axis 150 from the handle 300 to the housing 200 and into the housing opening 250. And, what, in essence, the seal 500 provides, can be referred to as a thin annular skirt 510 of resilient material that extends about the principal axis 150 and is pressed substantially flatly into engagement with an annular surface area (the area 290) of the housing 200 that extends substantially concentrically about the housing opening 250.

The housing 200 has a front side that is shown in FIG. 2, and a rear side that is shown in FIG. 6. The back wall opening 250 is a round hole that is concentric about the principal axis 150, and that provides communication between the front and rear sides of the housing 200. The handle 300, the spacer 400, the seals 500, 600, and such other elements as may be connected to the shaft 350 (several of which are described shortly) are intended to turn in unison about the principal axis 150—so that, when the handle 300 is grasped and turned, the shaft 350, the spacer 400, the seals 500, 600 and such components as may be connected to the shaft 350 on the rear side of the housing 200 turn essentially as a unit about the principal axis 150.

Although features of the present invention may be used with housings of a wide variety of configurations, the spacer 400 and the seals 500, 600 have proven to be well suited for use with housings having forwardly-facing recesses where moisture and debris may tend to collect, and where migration of moisture and debris through back wall openings of the housings may constitute a problem—and, for this reason, the type of housing selected for depiction in the drawings is the housing 200 which has a forwardly-facing recess 220.

Likewise, although features of the present invention may be used with handles of a variety of configurations, the spacer 400 and the seals 500, 600 have proven to be well suited for use with handles having retractable, nestable bails that may tend to exacerbate the collection of migratable dust and debris within the forwardly-facing recesses of housings—and, for this reason, the type of handle 300 selected for depiction in the drawings is one that has a retractable bail 310 configured to nest within the recess 220 of the housing 200.

Referring to FIGS. 2 and 6, the housing 200 has a substantially flat mounting flange 230 that surrounds the forwardly-facing recess 220. In preferred practice, the housing 200 is formed as a one-piece stamping from metal. A portion 232 of the mounting flange 230 located along one side of the recess 220 is enlarged to provide an area where a key-operated lock cylinder optionally can be mounted, if desired, for the purpose of retaining the handle 300 (as well as such other components as may be connected to the shaft 350) in one or a selection of desired orientations about the principal axis 150.

Figure 10:
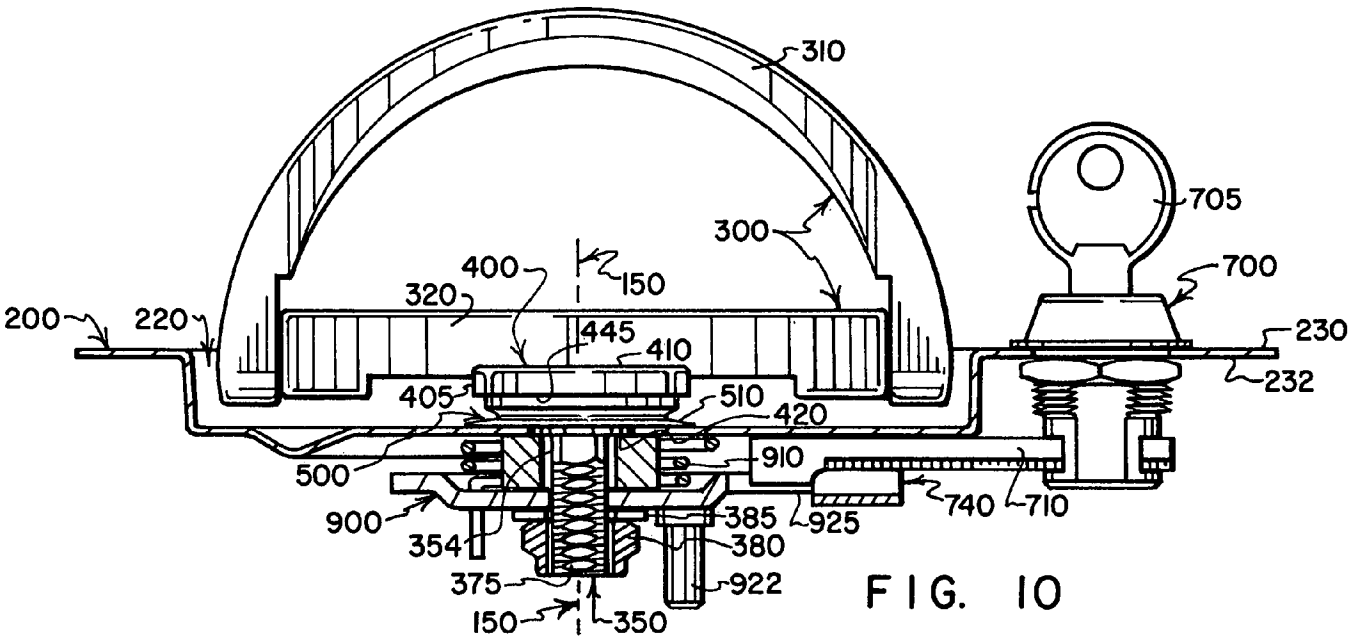
FIG. 10 is a sectional view similar to FIG. 9 but with the handle pivoted to an extended position, with a key inserted into the key cylinder, and with more of the components depicted in cross-section.
Figure 12:
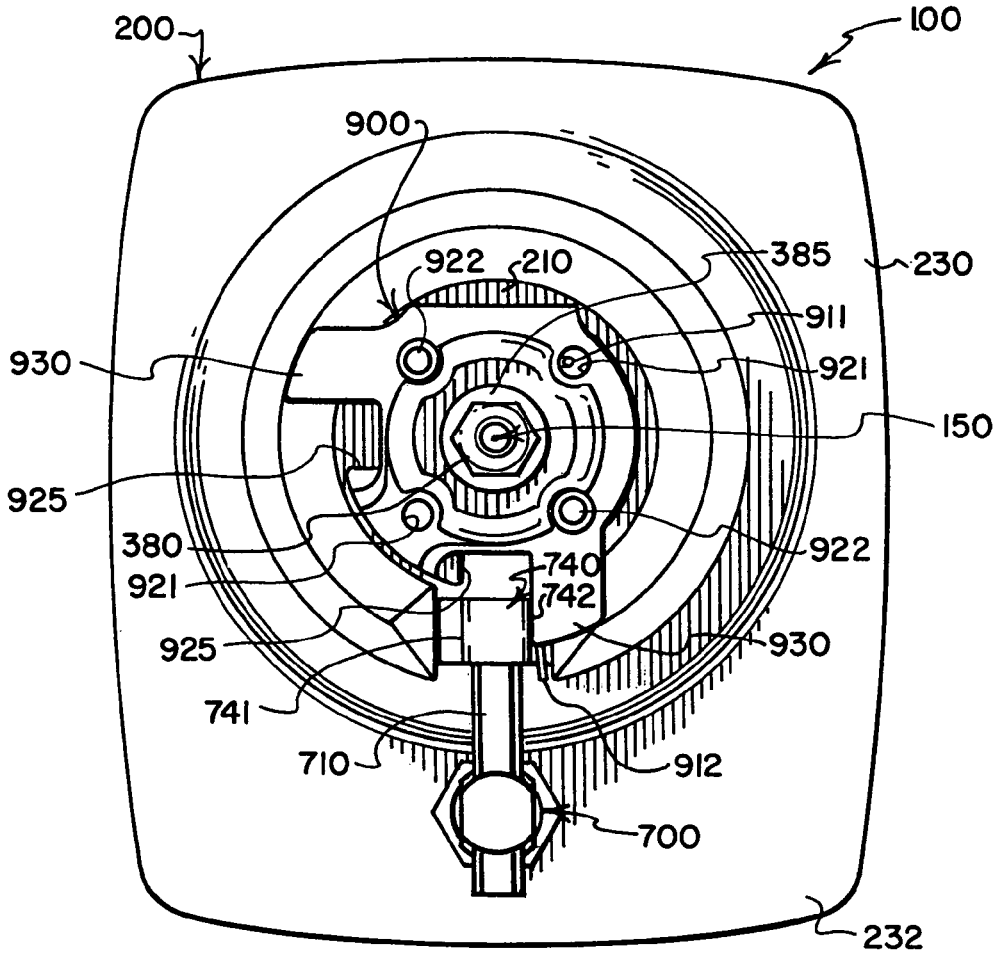
FIG. 12 is a rear elevational view similar to FIG. 7 but with the slidable bolt moved radially outwardly away from the principal axis to disengage the latch element, and with the latch element turned about the principal axis to a second position.
Figure 13:
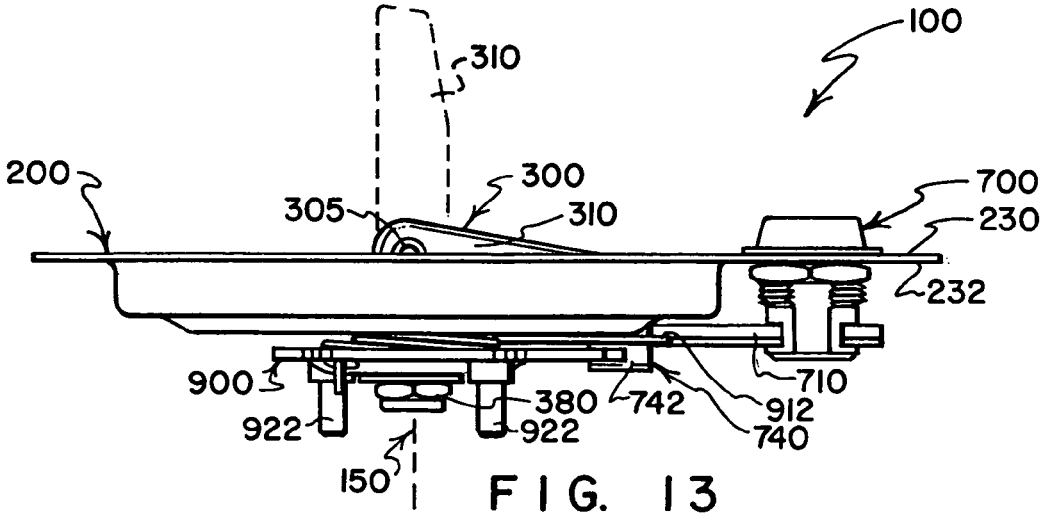
FIG. 13 is a side elevational view thereof.
Figure 14:
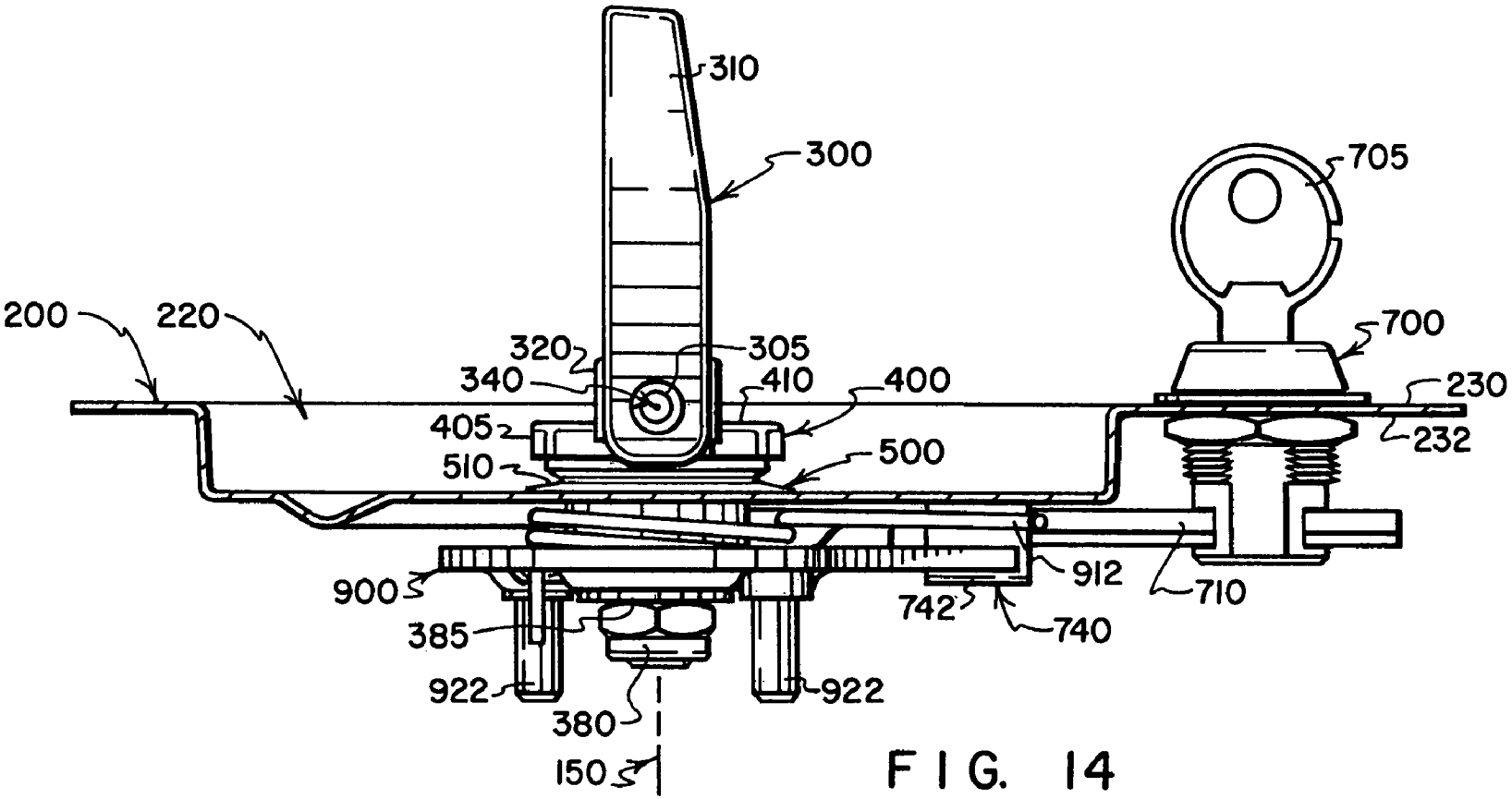
FIG. 14 is a sectional view similar to FIG. 9 but with the handle extended, and with the slidable bolt moved radially outwardly away from the principal axis to a position of disengagement with the latch member that permits the handle and the latch member to turn, in unison, about the principal axis.

In FIGS. 6-10 and 12-14, a conventional key operated lock cylinder 700 is shown installed in a conventional manner in a conventional lock-cylinder-mounting hole (not shown) formed through the enlarged mounting flange portion 232. In FIG. 10, a key 705 is shown inserted in the lock cylinder 700 and turned to a position that causes a slidable lock bolt 710 located on the rear side of the housing to extend radially inwardly toward the principal axis 150 to a "locked" position. In FIG. 14, the key 705 is shown turned a half turn in the lock cylinder 700 to cause the slidable lock bolt 710 move radially outwardly away from the principal axis 150 to an "unlocked" position.

Figure 7:
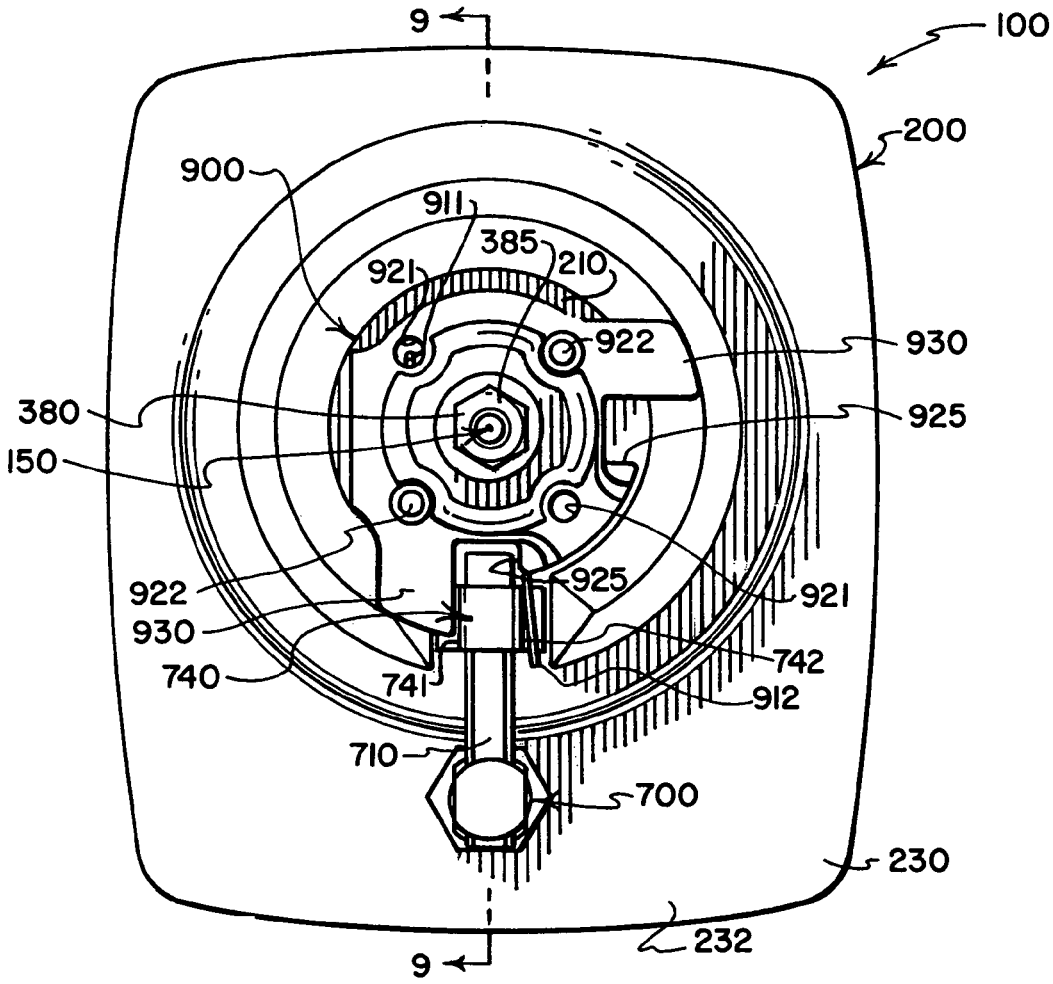
FIG. 7 is a rear elevational view showing rear features of the handle and housing assembly of FIG. 1 but with the components of FIG. 6 mounted on the shaft thereof (in place of the latch arm and other rear components shown in FIG. 5), with the latch element turned about the principal axis to a first position, and with the slidable bolt moved radially inwardly toward the principal axis to engage a notch of the latch element to retain the latch element in the first position.
Figure 8:
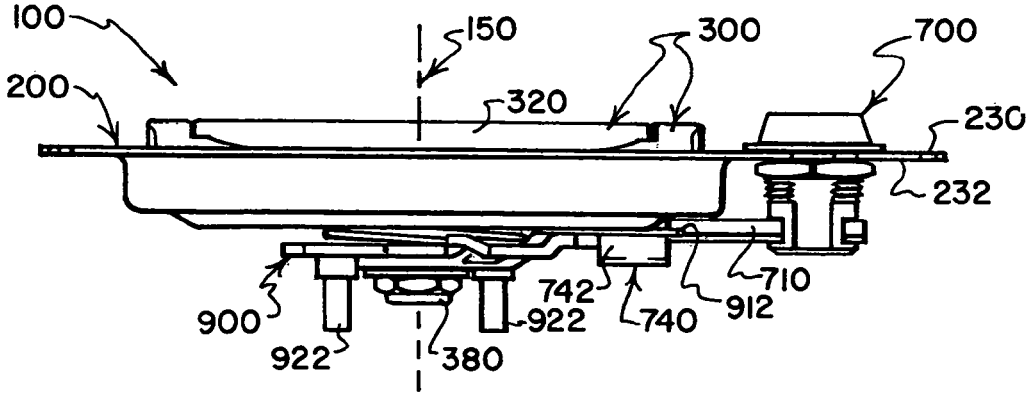
FIG. 8 is a side elevational view thereof.
Figure 9:
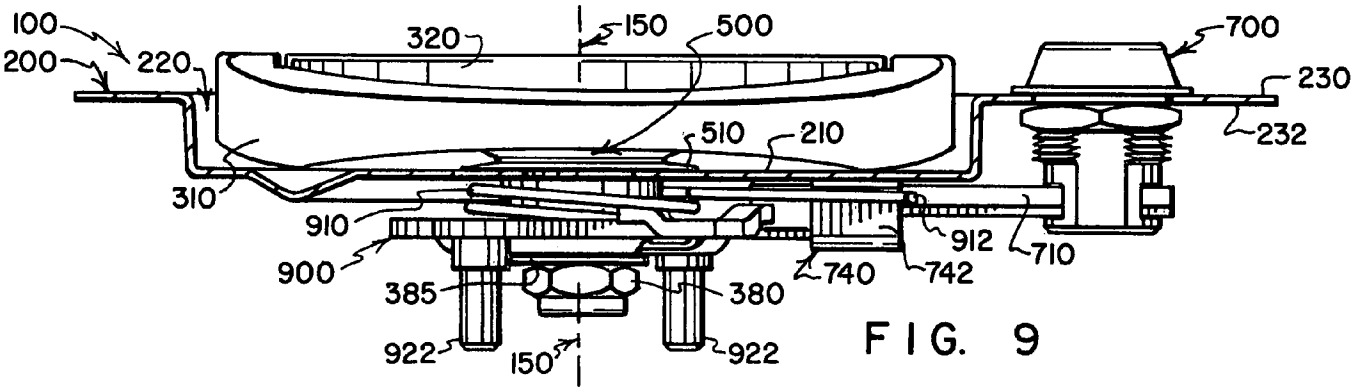
FIG. 9 is a sectional view as seen from a plane indicated by a line 9-9 in FIG. 7 with the handle retracted to reside in the forwardly-facing recess of the housing, and with only the housing shown in cross-section.

Referring to FIGS. 6, 7 and 12, a guide bracket 740 is welded to the rear face of the housing 200 and has a U-shaped, rearwardly extending central region 745 that wraps about and guides the slidable lock bolt 710 along its path of movement. Opposite sides of the central region 745 of the guide bracket 740 are indicated by the numerals 741, 742. One or both of the sides 741, 742 may be engaged by arms 930 of a latch element 900 (shown in FIG. 6) optionally mounted on the shaft 350 to limit the range of permitted turning movement of the handle 300 and the shaft 350; or may be engaged by arms 830 of a latch member 850 (shown in FIG. 5) to likewise limit the range of permitted turning movement of the handle 300 and the shaft 350. In FIGS. 7 and 12, engagements of the latch arms 930 with the sides 741, 742 of the bracket 740 are depicted.

Referring to FIG. 2, pivot pins 305 extend through holes provided in opposite end regions of the curved bail 310 of the handle 300 to pivotally connect the bail 310 to opposite end regions of the crossbar 320 of the handle 300. The pivotal connections provided between opposite end regions of the handle bail 310 and the crossbar 320 enable the bail 310 to pivot relative to the crossbar 320 about a "secondary axis" 340 between extended and retracted positions. The secondary axis 340 and the crossbar 320 extend transversely with respect to the principal axis 150. An extended position of the handle bail 310 is shown by solid lines in FIGS. 2, 5, 10, 11 and 14, and by broken lines in FIG. 13. A retracted position of the handle bail 310, is shown by solid lines in FIGS. 1, 6, 8, 9 and 13.

Referring to FIG. 2, the shaft 350 joins with the crossbar 320 of the handle at a location mid-way along the length of the crossbar 320 to form a T-shaped handle component 330 that, in preferred practice, comprises a single piece of metal. Likewise, for durability and longevity of service, the curved bail 310 and the pivot pins 305 also are preferably formed from metal.

Figure 5:
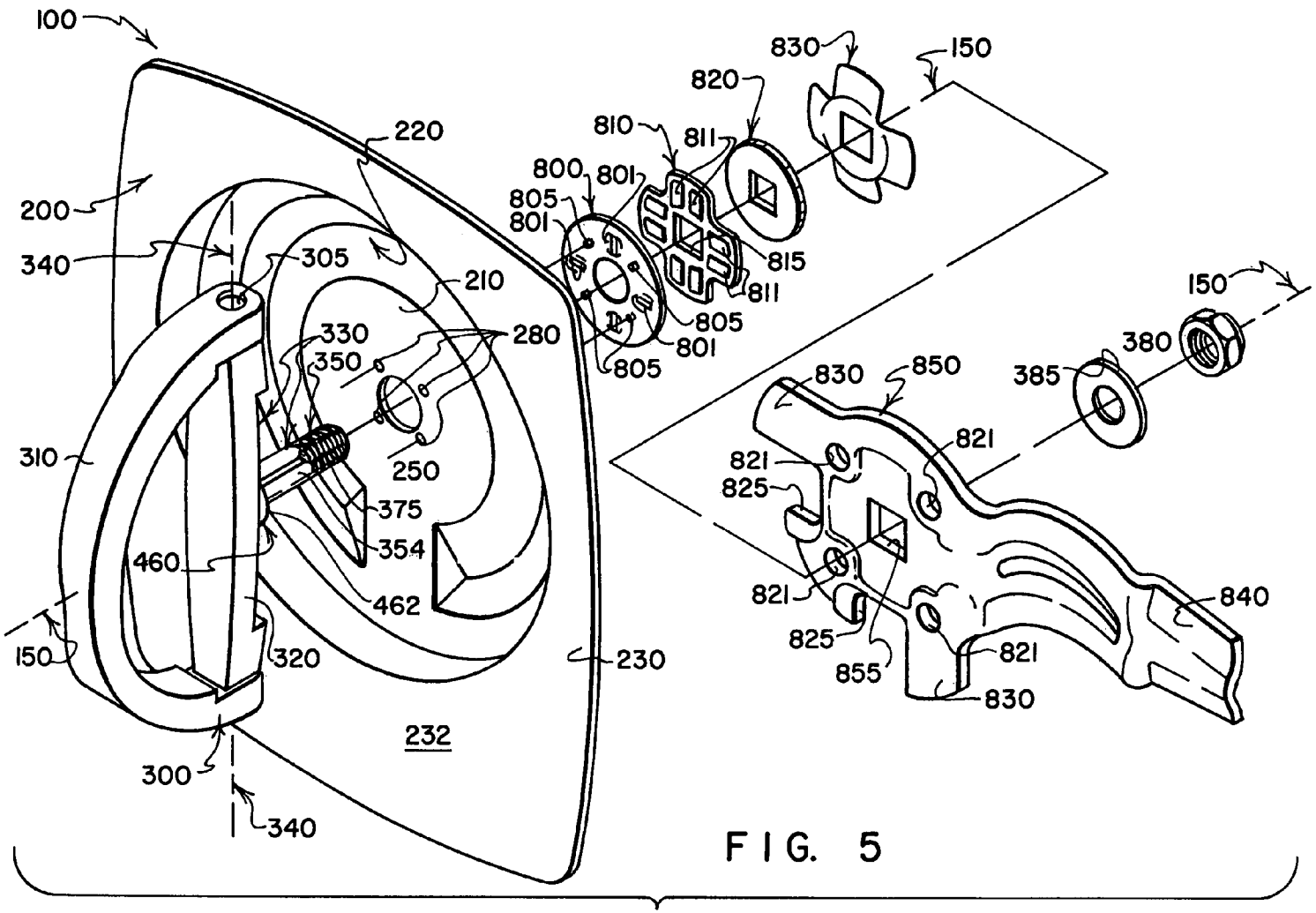
FIG. 5 is a perspective view showing the handle, the shaft, the housing and a selection of components that may be mounted on the shaft on the rear side of the housing, including a latch arm of the type shown in FIG. 1, and detent assembly elements that are configured to assist in retaining the latch arm in the positions depicted in FIG. 1.
Figure 11:
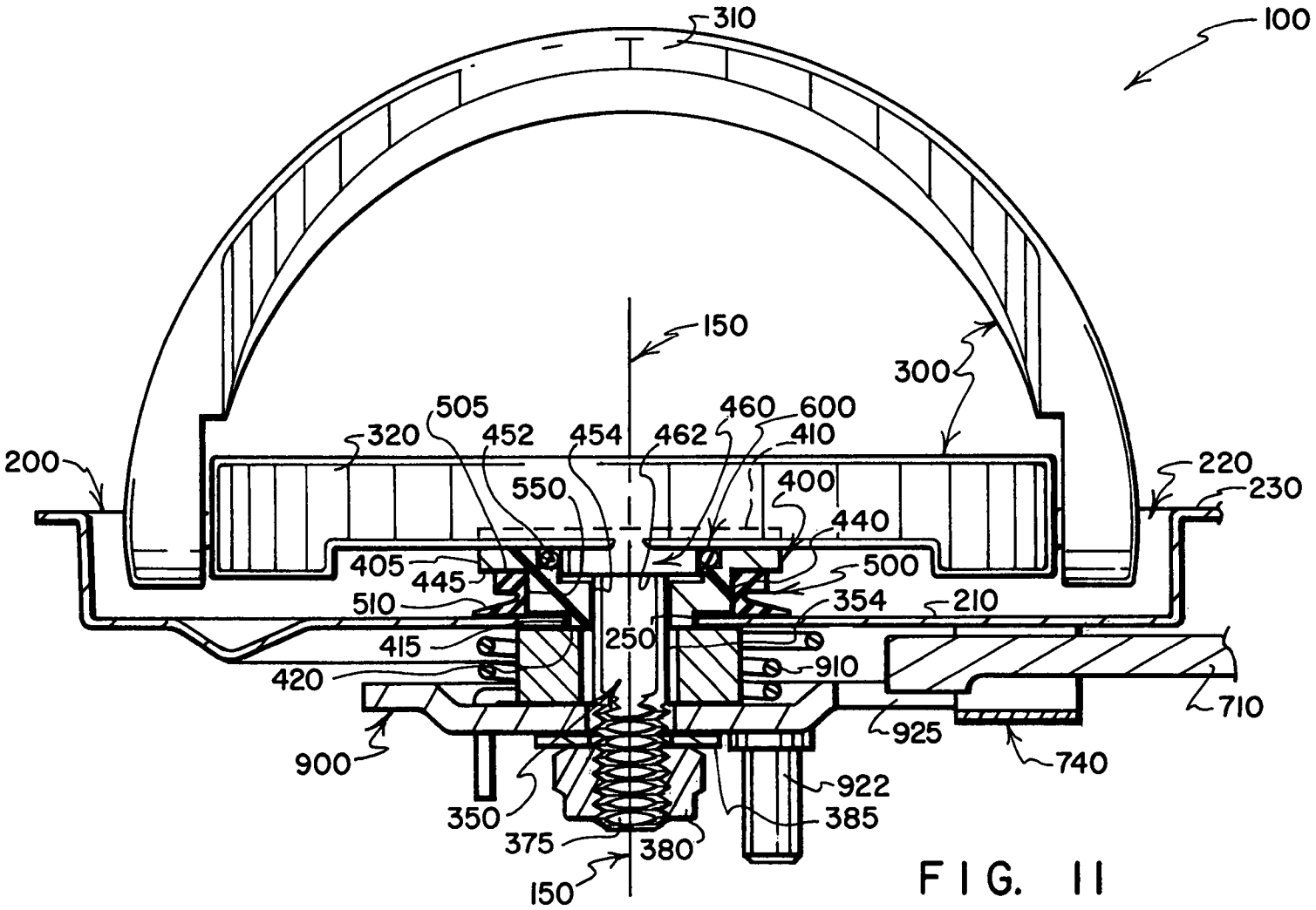
FIG. 11 is an enlargement of a portion of the sectional view of FIG. 10 but with still more components depicted in cross-section.

Referring to FIGS. 2, 5 and 11, the crossbar 320 is provided with a short, substantially cylindrical projection 460 that extends about the principal axis 150 to join with the shaft 350. Referring to FIG. 11, the cylindrical outer surface of the projection 460 is sized to permit the O-ring 600 to be installed thereon, and is connected by a rearwardly facing shoulder 462 to the shaft 350.

Referring to FIGS. 1-4 and 10, the spacer 400 has a generally square-shaped front portion 405 that defines a front face 410. Referring to FIGS. 3, 4, 6 and 11, the spacer 400 has a generally cylindrical rear projection 415 that defines a rear face 420. In preferred practice, the rear projection 415 is sized to be received in the housing's back wall opening 250 in a slip fit—by which arrangement, the generally cylindrical rear projection 415 cooperates with the housing opening 250 to facilitate smooth turning of the spacer 400, the shaft 350 and the handle 300 about the principal axis 150 relative to the housing 200.

Referring to FIG. 2, a transversely extending groove 430 opens forwardly through the front face 410 of the spacer 400. The groove 430 is configured to closely receive therein a central portion of the handle's crossbar 320 to assist in establishing a driving connection between the handle 300 and the spacer 400 to ensure that the handle 300 and the spacer 400 turn in unison about the principal axis 150. Augmenting the driving connection established by interfitting elements of the handle's crossbar 320 and the spacer's groove 430 is a square rear portion 354 of the shaft 350 that is received in a close fit within the square cross-section rear end region 454 of the passage 450 that extends centrally through the spacer 400.

Referring to FIG. 3, a front end region 452 of the spacer's central passage 450 has a cylindrical inwardly facing surface 452 with a diameter that permits the O-ring 600 to be inserted therein to a position wherein the O-ring 600 seats against a forwardly-facing shoulder 453. The shoulder 453 provides a transition between the diameter of the front end region 452, and a smaller diameter portion 456 of the passage 450 that is sized to receive in a slip fit the cylindrical outer surface of the crossbar projection 460. When the crossbar projection 460 is inserted into the passage portions 452, 456 with the O-ring seal 600 extending therearound, the O-ring seal 600 is compressed between the cylindrically inwardly facing surface 452 of the front end region of the spacer passage 450 and the cylindrically outwardly facing surface of the crossbar projection 460, and is held in place between the forwardly facing shoulder 453 of the spacer 400, and a rearwardly-facing surface portion of the crossbar 320. By this arrangement, the O-ring seal 600 has an extremely lengthy service life inasmuch as the components between which it is positioned do not normally move relative to each other, and it serves to minimize migration of moisture and debris between the handle 300 and the spacer 400, and through the spacer passage 450.

Referring to FIGS. 3, 4, 6 and 11, situated between the substantially square front formation 405 of the spacer 400 and the generally cylindrical rear projection 415 of the spacer 400 is a generally cylindrical central region 440 having a cylindrical outer surface 441 (FIG. 3) that extends along the principal axis 150 at a location between the handle 300 and the forwardly facing surface of the back wall 210 of the housing 200. The central region 440 has a diameter which is larger than the diameter of the rear projection 415, but smaller than the width of the substantially square front formation 405. A substantially flat, rearwardly facing shoulder 442 joins the central region 440 and the rear projection 415. A substantially flat, rearwardly facing shoulder 445 joins the central region 440 and the front formation 405, and serves to press against a front surface 505 of the skirted seal 500 when the seal 500 is installed on the central region 440 of the spacer 400 with a substantially cylindrical interior surface of a passage 550 that extends centrally through the seal 500 securely engaging the generally cylindrical outer surface of the central region 440 of the spacer 400.

Referring to FIG. 3, the seal 500 has a substantially cylindrical front formation 501 which has a generally cylindrical central passage 550 extending therethrough. Near the rear end of the passage 550, the seal 500 provides a thin band or ring of material 506 that integrally connects the cylindrical front formation 501 of the seal 500 to the thin annular skirt formation 510 of the seal 500. The generally cylindrical inner surface that forms the central passage 550 of the seal 500 is sized to fit snugly about the central region 440 of the spacer 400 to grip the surface 441. Firmly seated engagement of the front face 505 of the seal 500 with the rearwardly facing shoulder 445 of the spacer 400, and firmly seated engagement of the interior surface of the central passage 550 of the seal 500 with the exterior surface 441 of the central region 440 of the spacer 400 cooperate to establish a secure driving connection between the spacer 400 and the seal 500 that causes the spacer 400 and the seal 500 to turn in unison about the central axis 150 when the handle 300 turns the shaft 350.

Referring to FIG. 3, the seal 500 preferably is formed so that the rearwardly facing surface 515 of the skirt 510 of the seal 500 normally (i.e., when not pressed flatly into engagement with the back wall 210 of the housing 200) extends both outwardly and rearwardly from the rearwardly facing shoulder 442 of the spacer 400 toward the housing's back wall 210

(as depicted in FIG. 3) until the skirt 510 is pressed into engagement with the back wall 210 of the housing 200 (as depicted in FIG. 4), which causes the thin resilient skirt 510 to flatten so that at least a relatively wide outer band of the rearwardly facing surface 515 of the thin skirt 510 substantially flatly engages the ring-shaped portion 290 (FIG. 2) of the front surface of the back wall 210 that substantially concentrically surrounds the backwall opening 250 at a location spaced radially outwardly from the opening 250.

In preferred practice, the ring-shaped portion 290 of the front surface of the back wall 210 that is substantially flatly engaged by the skirt 510 of the seal 500 constitutes a relatively wide annular zone that is smoothly "wiped" by the skirt 510 when the seal 500 turns with the handle 300, the shaft 350 and the spacer 400 about the principal axis 150. By providing the relatively wide ring-shaped portion 290 of the front surface area of the back wall 210 that is snugly engaged and wiped by the skirt 510 of the seal 500 as the seal 500 turns about the principal axis 150, a seal is established between the spacer 400 and the housing 200 that serves quite effectively to minimize migration of moisture and particulate debris from within the housing recess 220 at locations exterior to the seal 500, toward the axis 150 and through the backwall opening 250.

If desired, friction between the seal 500 and the housing 200 can be diminished by coating the rearwardly facing surface 515 of the skirt 510 and/or the annular region 290 of the front surface of the back wall 210 with a greaseless dry lubricant. Care should be taken to ensure that no lubricant reaches the interior surface 550 or the front surface 505 of the seal 500 that engage the exterior surface 440 and the rearwardly facing shoulder 445 of the spacer 400, for friction is desired between these engaging surfaces to ensure that the seal 500 turns in unison with the spacer 400 about the principal axis 150.

In preferred practice, the annular portion 290 of the front surface area of the back wall 210 that is substantially flatly engaged by the skirt 510 is located radially outwardly and spaced from the perimeter of the back wall opening 250—by a distance that is sufficient to permit other holes that extend through the back wall 210 in the vicinity of the back wall opening 250 (such as the four small holes 280 depicted in FIGS. 2 and 5 as being arranged in an array about the back wall opening 250) to be enclosed within and surrounded by the annular portion 290. By this arrangement, the seal 500 not only serves to minimize the migration of moisture and debris from within the recess 220 of the housing 200 through the back wall opening 250, but also serves to minimize migration of moisture and debris through these additional back wall openings (such as the holes 280). The small holes 280 shown in FIGS. 2 and 5 may be useful because they can be drivingly engaged by small post-like projections 805 carried on a detent element 800 of the type depicted in FIG. 5—an element that is positioned adjacent the rear side of the back wall 210 of the housing and is engaged by another detent element 810 to releasably retain the handle 200 and the shaft 350 in one or a plurality of desired orientations about the principal axis 150.

Because the skirted seal 500 has the capability to establish a seal between the spacer 400 and the backwall 210 of the housing 200 that encircles all of the back wall openings 250, 280, the housing 200 can be provided with the openings 280 even if the openings 280 are not to be utilized and are not to be substantially closed by a component installed on the back side of the housing 200—hence, the same housing 200 can be provided for use with handle and housing assemblies intended for use in a wide variety of applications, regardless of whether they are to include any of the optional detent components shown in FIG. 5.

The remainder of the components that are referred to in the description that follows are of known, conventional form, and their use on handle and housing assemblies of a variety of types is well understood by those skilled in the art. These additional components are mentioned here and depicted in the drawings to provide examples of the wide variety of types of components that may be connected to the shaft 350 of the handle and housing assembly 100 to enable the handle and housing assembly 100 to serve a wide variety of purposes in a wide range of applications.

Referring to FIG. 5, the detent element 800 has forwardly extending post-like projections 805 that are configured to be received in the holes 280 formed through the back wall 210 of the housing 200—by which arrangement the washer-like detent element 800 can extend about the shaft 350 and will be prevented by the extension of the projections 805 into the holes 280 from turning about the principal axis 150. The companion detent element 810 has a square central opening 815 configured to drivingly engage the square rear portion 354 of the shaft 350 to be turned in unison therewith.

A four-leaved spring 830 is provided to press a rigid plastic washer 820 forwardly into engagement with the detent element 810, and to press the detent element 810 forwardly into engagement with the detent element 800 so that raised formations 801, 811 provided on the detent elements 800, 810 can engage when the shaft 350 is turned about the principal axis 150 to desired orientations to releasably detain the handle 300 and the shaft 350 in desired orientations about the principal axis 150—orientations that correspond to locations of the raised interengageable formations 801, 811 on the elements 800, 810, as will be readily understood by those skilled in the art.

Referring still to FIG. 5, a latch member 850 is provided with a square central opening 855 to receive and drivingly engage the square portion 354 of the shaft 350 so the latch member 850 will turn in unison with the shaft 350 and the handle 300 about the principal axis relative to the housing 200. The latch member 850 has an outer end region 840 that can be turned (by the shaft 350 when the shaft 350 turns about the principal axis 150) for example between a first position shown in solid lines in FIG. 1, and a second position shown by broken lines in FIG. 1, to engage a suitably configured latch strike (not shown) or other structure, for example to retain a closure (not shown—on which the housing 200 may be mounted) in a closed position.

If it is desired to lock the latch member 850 (together with the shaft 350 and the handle 300) in a specific orientation about the principal axis 150, the latch member 850 may be provided with one or more notches 825 that can be engaged by the slide bolt 710 of the key-operated lock 700—in the manner in which one or more notches 925 formed in a latch element 900 depicted in FIG. 6 are described later herein as being engaged by the slide bolt 710.

If it is desired to limit the range of angular movement through which the latch member 850 (together with the shaft 350 and the handle 300) may turn about the principal axis 150, the latch member 850 may be provided with arms 830 that, at opposite ends of a desired range of turning movement, may engage one or the other of two opposite sides 741, 742 of a slide bolt guide bracket 740 depicted in FIG. 6—in the manner in which arms 930 of the latch element 900 depicted in FIG. 6 are described later herein as being engaged by the slide bolt 710.

If it desired for the latch member 850 to connect with one or a plurality of elongate links (not shown) so that turning of the latch member 850 will pull or push the links to operate one or more remotely located latch assemblies (not shown), end regions of the links may be inserted through holes 821 formed through the latch member 850—or the latch member 850 may be provided with rearwardly projecting pin formations (not shown) of the type designated in FIG. 6 by the numeral 922, to which end regions of links may be connected.

If it is desired to bias the latch member 850 (together with the shaft 350 and the handle 300) to turn in a desired direction about the principal axis 150, a torsion coil spring 910 depicted in FIG. 6 may be installed for this purpose to engage the latch member 850—in the manner in which the spring 910 is installed to bias the latch element 900 depicted in FIG. 6, as described later herein.

Referring to FIG. 6, the latch element 900 has a generally L-shaped configuration, and is provided with a square central opening 905 through which the square region 354 of the shaft 350 can be inserted to drivingly connect the latch element 900 to the shaft 350 to turn with the handle 300 about the principal axis 150. The torsion coil spring 910 may extend around a spacer 920 installed on the shaft 350, and may have its end regions 911, 912 connected to the latch element 900 and to the housing 200 to bias the latch element in a desired direction about the principal axis.

In FIGS. 7 and 12, the spring end region 911 is shown extending through one of the holes 921 formed through the latch element 900 to connect the spring 910 to the latch element 900. In FIGS. 7-9 and 14 the spring end region 912 is shown engaging the side 742 of the slide bolt guide bracket 740 (which is welded to the rear face of the housing 200) to connect the spring 910 to the housing 200. If it is desired to bias the shaft 350 in an opposite direction about the principal axis, a spring (not shown) of opposite hand to the spring 910 (i.e., having a configuration that is a mirror image of the configuration of the spring 910) can be used in place of the spring 910, and an end of the replacement spring can engage the side 741 of the guide bracket 740 just as the depicted spring end 912 engages the guide bracket side 742.

Referring to FIG. 6, the elongate arms 930 of the latch element 900 give the latch element 900 a generally L-shaped configuration, and serve to limit the permitted range of angular turning movement of the shaft 350 and the handle 300 about the principal axis to a quarter turn (i.e., a turning movement range of ninety degrees). When at one end of this permitted range of turning movement, one of the arms 930 engages the side 741 of the slide bolt guide bracket 740, as is depicted in FIG. 7. When at the other end of this permitted range of turning movement, the other of the arms 930 engages the opposite side 742 of the slide bolt guide bracket 740, as is depicted in FIG. 12.

If the range of permitted turning movement of the shaft 350 and the handle 300 is to be something other than a quarter turn, the arms 930 of the latch element 900 (and, likewise, the arms 830 of the latch member 850 depicted in FIG. 5) can be reconfigured to extend not at right angles to each other, but at other relative angles, as will be readily understood by those skilled in the art.

How the slide bolt 710 of the lock 700 can extend inwardly (guided by the slide bolt guide bracket 740) toward the principal axis 150 to engage one of the notches 925 of the latch element 900 to retain the latch element 900 in desired orientations about the principal axis 150 is illustrated in FIG. 7. How the slide bolt 710 can extend outwardly (guided by the slide bolt guide bracket 740) away from the principal axis 150 to disengage the latch element 900 so the handle 300, the shaft 350 and the latch element 900 can turn about the principal axis 150 is illustrated in FIGS. 12-14.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention. It is intended that the patent shall cover by suitable expression in the appended claims whatever features of patentable novelty exist in the invention disclosed.

What is claimed is:

1. Apparatus comprising an assembly of a housing and a handle, the housing having a wall through which an opening provides a passage that connects a forwardly facing surface and a rearwardly facing surface of the wall, the handle being graspable, being located forwardly of the wall and the opening, and having a shaft connected thereto that extends rearwardly from the handle through the opening along a principal axis about which the handle can be turned relative to the housing when grasped, the assembly further including a spacer drivingly connected to the handle to turn therewith about the principal axis, the spacer having one generally cylindrical portion extending along the principal axis from the handle to the forwardly facing surface of the wall, and having another portion extending through the opening of the wall, and the assembly further having a single piece, integrally formed, three part seal having a first part that defines a substantially cylindrical formation of the seal that extends closely about and frictionally grips the generally cylindrical portion of the spacer to drivingly connect the seal to the spacer to turn therewith about the principal axis, the seal having a second part that defines a thin annular skirt formation of resilient material that extends continuously and without interruption from the generally cylindrical portion of the spacer where a third part of the seal formed by only a thin ring of material located adjacent the cylindrical portion of the spacer integrally connects the first part of the seal to the second part of the seal, with the thin annular skirt formation of resilient material fully underlying the cylindrical formation of the seal and being pressed flatly into engagement with only an annular surface portion of the forwardly facing surface of the housing wall that concentrically encircles the opening at a location on the forwardly facing surface spaced radially outwardly away from the opening, with the thin, flattened, annular skirt formation that forms the third part of the seal being the only portion of the seal that engages the housing wall and wipes along the annular surface portion of the forwardly facing surface of the housing wall when the handle is grasped and turned to cause the seal, the spacer and the handle to turn in unison with the shaft about the principal axis.

2. The apparatus of claim 1 wherein the shaft extends from the handle through the spacer, through the seal and through the opening defined by the housing wall.

3. The apparatus of claim 2 additionally including an O-ring seal compressed between overlying surfaces of the handle and the spacer that do not move relative to each other when the handle turns about the principal axis.

4. The apparatus of claim 2 additionally including an O-ring seal installed within a passage formed through the spacer and compressed between selected surfaces of the spacer and of at least a selected one of the handle and the shaft, which selected surfaces do not move relative to each other when the handle turns about the principal axis.

5. The apparatus of claim 1 wherein the spacer has a rear portion that extends into the opening defined by the housing in a slip fit to facilitate smooth turning of the handle and the spacer about the principal axis relative to the housing.

6. The apparatus of claim 1 additionally including a spring connected to the housing and biasing the shaft to turn in a selected direction about the principal axis.

7. The apparatus of claim 1 additionally including a latch element connected to the shaft, and a key-operated lock connected to the housing and having a bolt that can be moved into engagement with the latch element to lock the handle, the shaft and the latch element in a selected orientation about the principal axis.

8. The apparatus of claim 1 additionally including a latch element connected to the shaft and having at least one arm formation that is engageable with a formation of the housing to limit a range of permitted turning movement of the handle, the shaft and the latch element about the principal axis.

9. The apparatus of claim 2 wherein the handle has a crossbar that transversely intersects the principal axis, and has a projection extending from the crossbar along the principal axis that defines a surface of the handle that engages the O-ring.

10. The of claim 2 wherein the spacer has a passage formed substantially centrally therethrough that extends along the principal axis, and the passage has an interior portion that defines a surface of the spacer that engages the O-ring.

11. The apparatus of claim 10 wherein the passage formed through the spacer has an interior portion that is of substantially square cross-section, and the shaft has an exterior surface of substantially square cross-section drivingly engaged therewith.

12. The apparatus of claim 9 wherein the spacer defines a groove that extends transversely relative to the principal axis and receives a portion of the crossbar therein.

13. The apparatus of claim 1 wherein the structure spacer includes a front portion configured to closely engage the handle near where the shaft connects with the handle, and having a rear portion configured to engage a central region of the forwardly facing surface that rings the opening.

14. The apparatus of claim 13 wherein a front part of the resilient skirted seal is configured to press against a rearwardly facing shoulder of the spacer located near a juncture of the front and rear portions of the spacer.

15. The apparatus of claim 13 wherein the shaft has a threaded rear portion onto which a threaded fastener can be tightened to draw the handle, the spacer and the seal toward the forwardly facing surface.

16. The apparatus of claim 1 additionally including an O-ring seal interposed between and snugly engaged by a generally cylindrical surface defined by the handle at a location near where the handle is connected to the shaft, and a generally cylindrical interior wall of a recess defined by the front portion of the spacer that encircles the generally cylindrical surface defined by the handle, wherein the generally cylindrical surface defined by the handle and the generally cylindrical interior wall of the recess do not move relative to each other when the handle turns about the principal axis.

17. The apparatus of claim 16 wherein the handle has a crossbar extending transversely with respect to the principal axis, wherein a central region of the crossbar connects with a front end of the shaft, and wherein the spacer defines a forwardly facing, transversely extending groove that receives the central region of the crossbar.

18. The of claim 17 wherein the central region of the crossbar defines a generally cylindrical formation that extends rearwardly along the principal axis, wherein the front portion of the spacer defines a generally cylindrical recess configured to receive the generally cylindrical formation, and wherein an O-ring is provided within the recess to extend closely about the generally cylindrical formation to minimize migration of moisture and debris through the recess between the handle and the spacer.

* * * * *